United States Patent [19]

Ross, Jr.

[11] Patent Number: 4,866,790

[45] Date of Patent: Sep. 19, 1989

[54] TUCKAWAY GARMENT

[76] Inventor: John R. Ross, Jr., 13020 Long Boat Way, Del Mar, Calif. 92014

[21] Appl. No.: 212,075

[22] Filed: Jun. 27, 1988

Related U.S. Application Data

[63] Continuation-in-part of Ser. No. 940,769, Dec. 12, 1986, abandoned.

[51] Int. Cl.[4] ..... A41D 3/00

[52] U.S. Cl. ..... 2/84; 2/69; 2/DIG. #1; 2/DIG. #3; 2/90; 2/115

[58] Field of Search ..... 2/DIG. #1, 2/DIG. #3, 115, 49 R, 90, 148, 145, 144, 84, 88, 69

[56] References Cited

U.S. PATENT DOCUMENTS

| | | | |
|---|---|---|---|
| 1,632,346 | 6/1927 | Nissen | 2/90 |
| 2,728,916 | 1/1956 | Clarke et al. | 2/84 X |
| 3,144,660 | 8/1964 | Portaro | 2/84 X |
| 3,187,396 | 6/1965 | Carroll | 2/148 X |
| 3,229,875 | 1/1966 | Stoller | 2/49 R X |
| 3,946,443 | 3/1976 | Knight | 2/84 X |
| 4,118,802 | 10/1978 | Polster | 2/84 |
| 4,310,927 | 1/1982 | DeBose | 2/115 |
| 4,313,229 | 2/1982 | Villafane | 2/84 |

FOREIGN PATENT DOCUMENTS

| | | | |
|---|---|---|---|
| 2459012 | 2/1981 | France | 2/DIG. #3 |
| 2507064 | 12/1982 | France | 2/DIG. #3 |

*Primary Examiner*—H. Hampton Hunter

[57] ABSTRACT

Low cost tuckaway garment which protects wearer against cold wind or rain and can be rolled or folded up when not needed and tucked into a pocket. The garmet is comprised entirely or essentially entirely of thin polyethylene sheet. A preferred embodiment is a windbreaker made of high density polyethylene having an opening at the top for the wearer's head, a long turtleneck and essentially identical front and back joined together by heat joining.

3 Claims, 4 Drawing Sheets

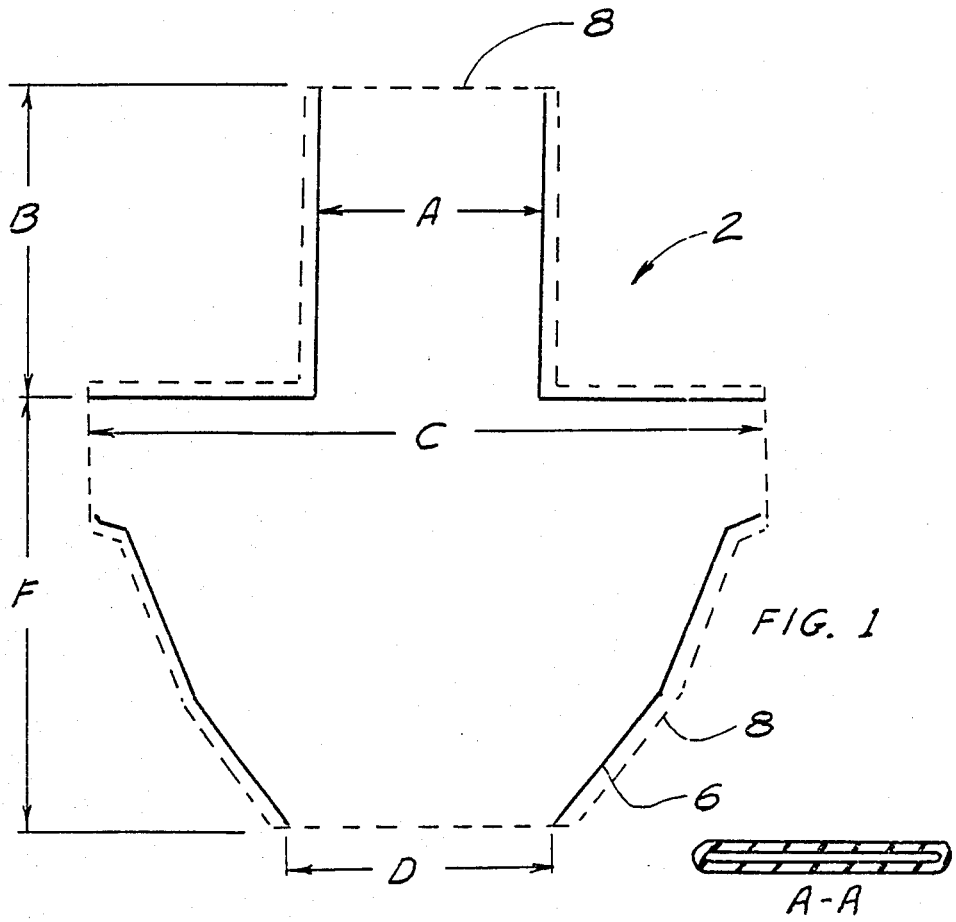
FIG. 1
FIG. 2B
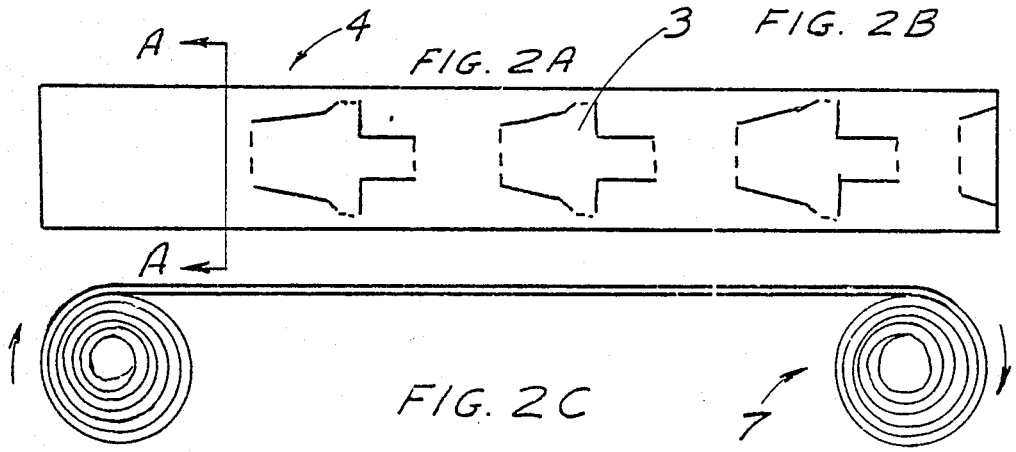
FIG. 2A
FIG. 2C

TUCKAWAY GARMENT

This is a continuation-in-part of application Ser. No. 940,769, filed Dec. 12, 1986 and now abandoned.

This invention relates to garments and in particular to low cost disposable garments.

BACKGROUND OF THE INVENTION

Plastic raincoats and plastic ponchos have been available for many years. Very thin sheets of polyethylene have been used for many years to make inexpensive disposable laundry bags and garbage bags have been made from thicker sheet polyethylene. More recently density sheet polyethylene has been used to make inexpensive shopping bags.

Almost every weekend morning at about sunrise, I leave my house for a 4 to 5 hour bicycle ride. If I dress for the first 20 minutes, I have to carry unneeded clothing for the rest of the trip, and if I dress for the rest of the trip, I am cold for the first 20 minutes. Early morning joggers, school children leaving for school at dawn and millions of other early risers have simular problems. What is needed is a garment, preferably low cost, that can be worn for a few minutes then taken off and either disposed of or preferably rolled or folded into a very small package and tucked away in a pocket, pocketbook or brief case for the rest of the day.

SUMMARY OF THE INVENTION

The present invention provides a very low cost garment which protects the wearer against cold wind and rain and can be rolled or folded up when not needed and tucked into a pocket, pocket book or brief case. The grament is constructed entirely or essentially entirely of polyethylene sheet having a thickness of less than 150 microns. A preferred embodiment is a windbreaker made of high density polyethylene having an opening at the top for the head, two openings for the arms and an opening at the bottom and comprising a turtleneck at least 8 inches long and a front side and a back side which are essentially identical and joined together by heat sealing. This preferred embodiment made to fit an average size person can be rolled up and tucked in a space of a cube having 1.4 inch sides.

BRIEF DESCRIPTION OF THE DRAWINGS

FIG. 1 is a drawing of a pattern for making a preferred embodiment of the present invention.

FIG. 2A is a sketch showing how the preferred embodiment referred to above can be made on a continuous basis.

FIG. 2B shows a cross section of a polyethylene tube which can be used in producing this preferred embodiment.

FIG. 2C shows a side view of a roll of polyethylene tube and a roll containing a large number of a preferred embodiment of the present invention.

DESCRIPTION OF THE PREFERRED EMBODIMENTS

Figure 5:
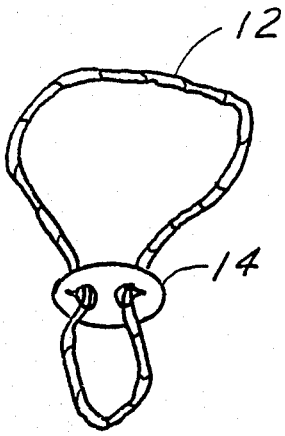
FIG. 5 is a sketch of a string necktie used to keep tight the neck of this preferred embodiment.

Preferred embodiments of the present invention may be described by reference to the figures.

FIG. 1 shows a pattern 2 for the fabrication of a windbreaker in accordance with the present invention. The windbreaker 3 as shown in FIG. 2A is fabricated from a high density polyethylene tube 4 having a diameter of about 25.5 inches and wall thickness of 15 microns. The tube can be purchased in rolls 5. The tube when flattened as shown in FIGS. 2A, 2B, and 2C, is equivalent to two sheets of polyethylene 40 inches wide and many 100 feet long. Such tubes are available from many distributors in the United States and elsewhere. One such distributor is San Diego Bag and Supply Company, 7740 Formula Place, San Diego, Calif. Resin from which the tubes are made is made by Arco Petrochemical, Monsanto And Dupont. The windbreakers are fabricated by heat joining the front of the windbreaker to the back with a heating element having the shape described by heavy solid line 6 in FIG. 1. The two sheets of polyethylene are perforated by pointed knife edges as indicated by dashed line 8 in FIG. 1 so that the windbreaker can be easily removed from the remainder of the tube. Preferably, windbreakers are fabricated on a continuous basis as shown in FIG. 2A, the sealing and perforations being done in one operation. Tube 4 can be rolled up as shown at 7 with the windbreakers still a part of the tube for shipment or the windbreakers could be separated out at this stage.

Figure 3:
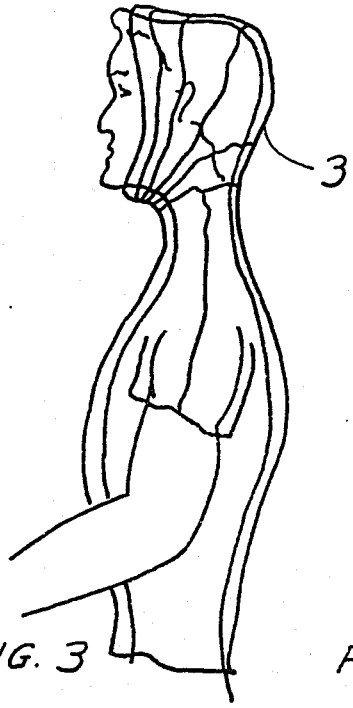
FIG. 3 shows a person wearing this preferred embodiment.
Figure 4:
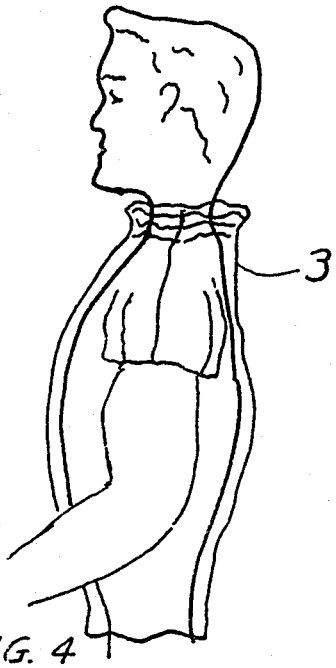
FIG. 4 shows a person wearing this preferred embodiment in a slightly different manner from that shown in FIG. 3.
Figure 6:
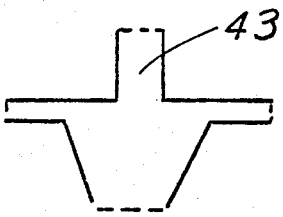
FIG. 6 is a pattern for a second preferred embodiment.
Figure 7:
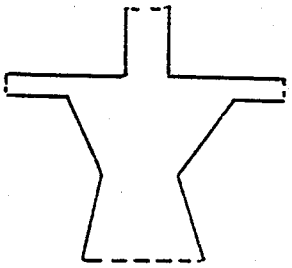
FIG. 7 is a pattern for a third preferred embodiment.
Figure 12:
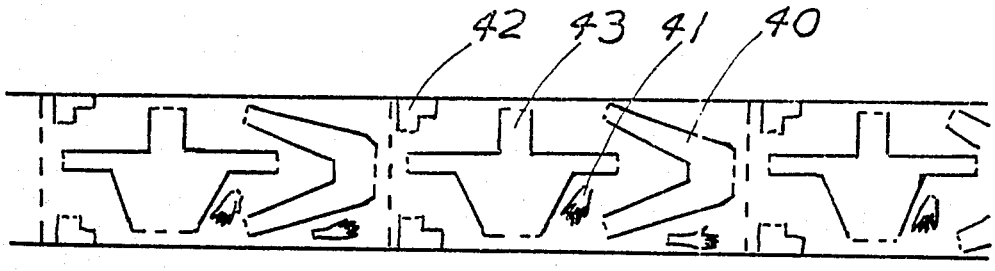
FIG. 12 is a sketch showing how a low cost rain outfit is produced on a continuous basis.
Figure 13:
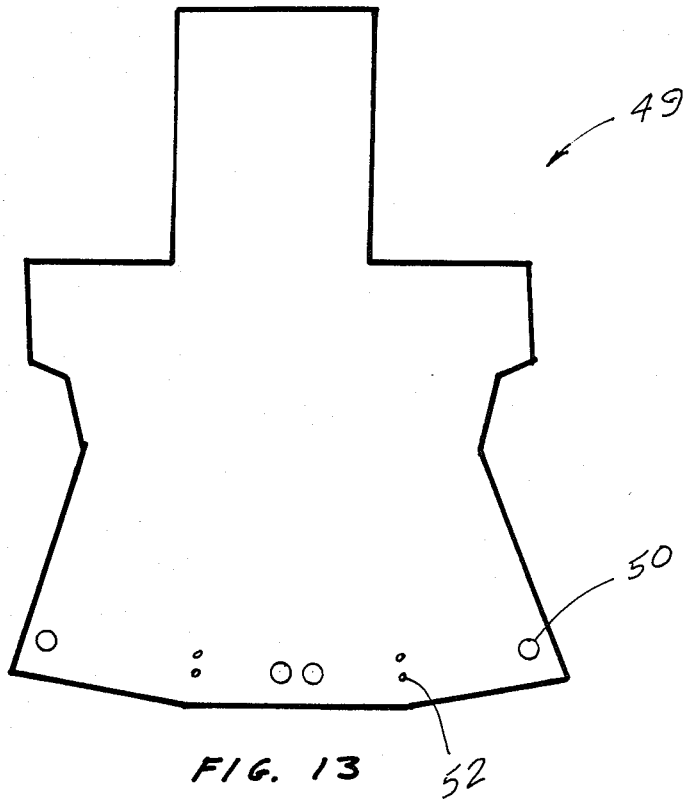
FIGS. 13, 14, 15 and 16 are four views of a tuckaway raincoat.

Dimension A should be slightly larger than ½ the circumference of the head of the potential wearers so the head can easily slide through the opening. Dimension D should be large enough for the wearers shoulders to fit through. Dimension E should be large enough for his arms to fit through with about 1 or 2 inches extra. In my preferred embodiment for a medium sized person, A was 14", C was 39", D was 21", E was 7", F was 26". Dimension B was either about 8" or about 20". If the 20" version is made it can either be worn with the turtleneck part as a hood as shown in FIG. 3 or as a turtleneck as shown in FIG. 4. The 8" version can only be worn as a turtle neck. As an added extra I provide a low cost necktie as shown in FIG. 5. The necktie is comprised of a cotton string 12 and plastic tightener 14. It is worn around the turtleneck of windbreaker 10 and can be tightened to prevent warm air from escaping around the neck. The bottom of windbreaker is normally stuffed inside the wearers pants;

however, a belt tie simular to the necktie could be provided. The sleeves could be simularly sealed. I have also used rubber bands to seal the sleeves. FIG. 6 is a sketch of a long sleeve windbreaker, and in FIG. 7 I show a skirt which makes the FIG. 6 embodiment into an inexpensive lightweight raincoat. FIG. 12 is a sketch of pants made in accordance with the present invention. FIG. 13 shows how a complete biking rain set, including pants 40, gloves 41, shoe covers 42 and a long sleeve windbreaker 43, could be fabricated on a continuous basis.

My initial idea was to make a disposable windbreaker, but I was surprised to discover that when used to keep me warm on my bike rides, my windbreaker can be used over and over again and lasts for months. I started out using relatively thick polyethylene; then I switched to 15 micron high density polyethylene which works very well. I even tried extremely thin 0.00045 gage polyethylene which is used for dry cleaning bags and it works very well with the design shown in FIG. 1. I found that the polyethylene tube is very strong with not much tendency to tear, and I emphasis its use in my preferred embodiments. I recommend use of thicknesses of less than 150 microns when using high density polyethylene because greater thicknesses tend to be brittle.

The windbreaker is generally worn over other garments such as a cotton shirt or a cotton shirt and a wool sweater; however, the windbreaker may be worn next to the skin. If the polyethylene is clear it will transmit most light. Therefore, the windbreaker shown in FIG. 1 can be used as a tanning shirt. It may be possible to add ingredients to the polyethylene to absorb harmful ultraviolet radiation but permiting tanning rays to pass through so as to greatly reduce the cancer hazard associated with sunning and at the same time obtain great tans. Fluorescent isothyocyanide can be added to make the windbreaker fluorescent. Bright colors can be added. Either would be a great benefit to make bicycle riders more visible or obvious to drivers of motor vehicles. Sweating can be a problem if the wearer gets too hot while wearing the windbreaker. My preferred embodiments are generally rather baggy which minimizes problems associated with the fact that the polyethylene does not "breathe". Opening the neck minimizes this problem. Also, the windbreaker can be reversed to let what was the inside dry out. Lack of breathing can be a real benefit when starting out on a bike trip at 25 mph when the temperature is 40F. And preferably the windbreaker is worn for only a few minutes to about an hour, then tucked away.

Figure 11:
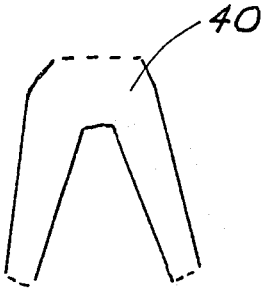
FIG. 11 is a sketch of a pair of pants made in accordance with the present invention.
Figure 8A:
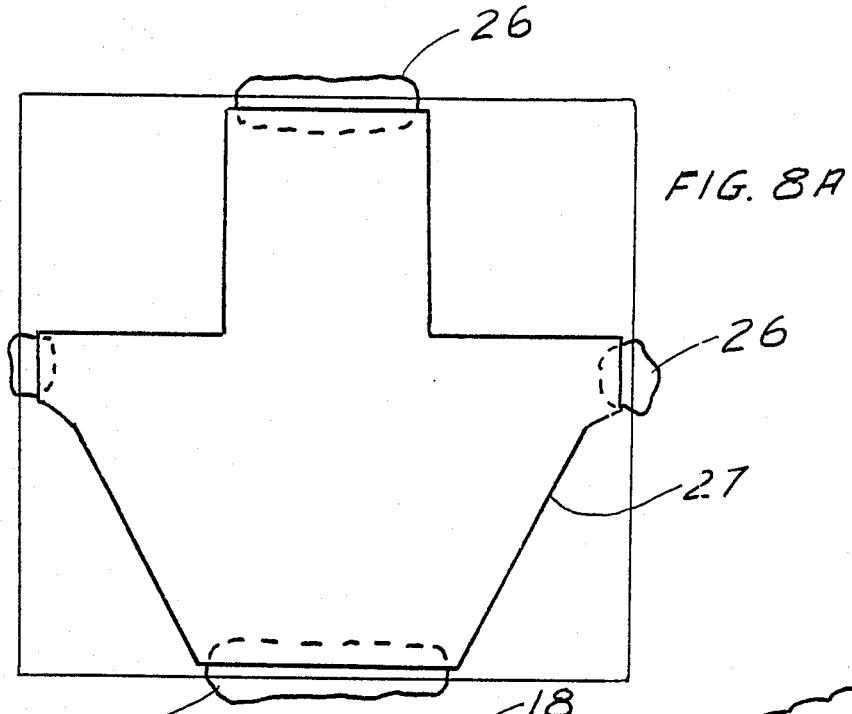
FIG. 8A is a sketch showing how to construct a fourth preferred embodiment of the present invention.
Figure 8B:
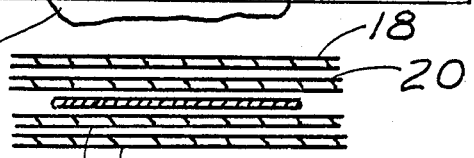
FIG. 8B is a view of the bottom of the embodiment shown in FIG. 8A showing how two layers are sealed without sealing off the bottom of the garment.
Figure 10:
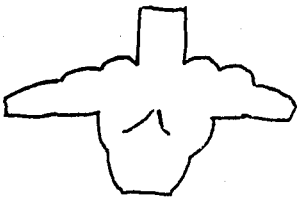
FIG. 10 is a sketch of an embodiment simular to that shown in FIG. 8A but modified to simulate high muscles.
Figure 8C:
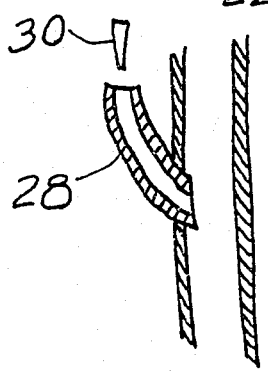
FIG. 8C is a sketch showing the stem through which the embodiment referred to in FIG. 8A is inflated.
Figure 9:
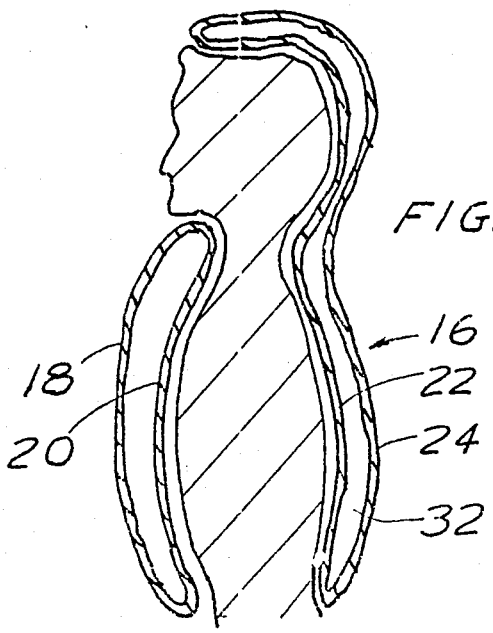
FIG. 9 is a cross sectional view of a person wearing the embodment referred to in FIG. 8A.

My really cold weather embodiment is shown in FIGS. 8A, 8B and 9. The pattern shown in FIG. 1 is used to produce windbreaker 16 having four layers<two front layers 18 and 20 and two back layers 22 and 24>. Tefflon spacers 26 are placed in the head, arm and body openings a shown in FIG. 8A and FIG. 8B. The layers are sealed along line 27. Windbreaker 16 is then turned over and layers 22 and 24 behind teflon spacer 26 are sealed in a like manner. Thus, air tight bags form the front and back of windbreaker 16. Thin polyethylene tubes 28 are inserted as shown in FIG. 8C at convenient places and heat sealed in place so that the front and back can be blown up by the wearer after the windbreaker is put on. A good place is at the side of the neck of the windbreaker. Other good spots are on the arms. The windbreaker is put on and blown up through tubes 28 until the thickness of cavity 32 averages about 2 inches as shown in FIG. 9. Plugs 30 are inserted in tubes 28. The resulting windbreaker thus provides excellent inexpensive insulation. Slight modifications of the embodiment described in FIGS. 8A, 8B, 8C and 9 can be made as indicated in FIG. 11 to simulate hugh muscles when the windbreaker is blown up. Simularily, as shown in FIG. 10 hugh bosoms could be simulated. These might be especially fun on the ski slopes or the beach.

Figure 14:
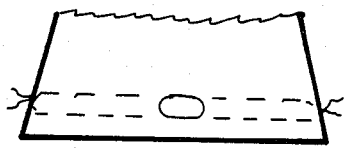
Figure 15:
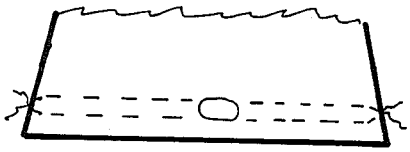
Figure 16:
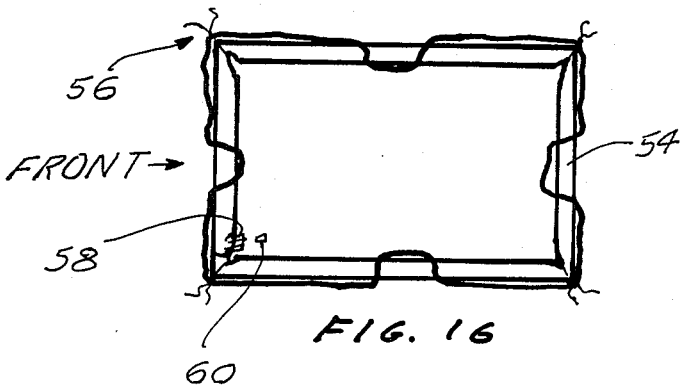

FIG. 13 is a drawing of a pattern of a tuckaway raincoat 49. It is simular to the pattern shown in FIG. 1 except the bottom is flared and contains eight 1-inch diameter holes 50 and eight ⅝-inch diameter holes 52. As shown in FIGS. 14, 15, and 16, a 1-inch diameter tube 54 made of the same material as main part of the raincoat 49 is attached near the bottom of the garment in a circumferential manner. Tube 54 passes through holes 50 and is tied at holes 52 with string 56 to attach tube 54 to coat portion of the raincoat 49 and to reduce the tube diameter at holes 52 to about ¼-inch. Tube 54 is sealed at one end and inflated through small polyethylene tube 58 at the other end which is plugged with plug 60. When tube 54 is thus inflated the bottom of raincoat 49 assumes a generally rectangular shape as shown in FIG. 16. When worn in the rain, tube 54 holds the bottom of raincoat 49 away from the hips of the wearer so that water dripping off raincoat 49 will tend to fall away from the feet and legs of the wearer.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

I claim:

1. A low cost mass producable garment for a person, said garment being sufficient to cover all or essentially all of the torso of said person above his waist and being comprised of:

two sleeves, a turtleneck at least 20 inches long having an opening at the top, and a torso cover said two sleeves, said turtleneck and said torso cover being comprised entirely of a front piece of sheet polyethylene having a thickness of less than 150 microns and a back piece essentially identical to said front piece, said front piece being joined to said back piece and said turtleneck being sized to be utilized as a hood with the persons face protruding through the turtleneck opening.

2. A garment in accordance with claim 1 wherein said garment also comprises an additional polyethylene sheet heat sealed to the front or back piece to form at least one cavity and means for filling said cavity with air, trapping said air in said cavity and releasing said air from said cavity.

3. A garment in accordance with claim 17 wherein the bottom of said garment defines a bottom circumference of said garment and said garment also comprises an inflatable polyethylene tube positioned along said bottom circumference.

* * * * *